US011904917B2

(12) United States Patent
Lin et al.

(10) Patent No.: US 11,904,917 B2
(45) Date of Patent: Feb. 20, 2024

(54) ANTI-COLLISION CONTROL METHOD AND RAIL VEHICLE CONTROL SYSTEM

(71) Applicant: MIRLE AUTOMATION CORPORATION, Hsinchu (TW)

(72) Inventors: Shih-Wei Lin, Hsinchu (TW); Hsing-Lu Huang, Hsinchu (TW); Wun-Jian Wei, Hsinchu (TW)

(73) Assignee: MIRLE AUTOMATION CORPORATION, Hsinchu (TW)

( * ) Notice: Subject to any disclaimer, the term of this patent is extended or adjusted under 35 U.S.C. 154(b) by 444 days.

(21) Appl. No.: 17/178,195

(22) Filed: Feb. 17, 2021

(65) Prior Publication Data

US 2021/0331726 A1 Oct. 28, 2021

Related U.S. Application Data

(60) Provisional application No. 63/016,388, filed on Apr. 28, 2020.

(30) Foreign Application Priority Data

Sep. 25, 2020 (TW) ..... 109133233

(51) Int. Cl.
*B61L 27/20* (2022.01)
*B61L 25/02* (2006.01)
*B61L 23/14* (2006.01)

(52) U.S. Cl.
CPC ..... *B61L 27/20* (2022.01); *B61L 23/14* (2013.01); *B61L 25/025* (2013.01); *B61L 2027/204* (2022.01)

(58) Field of Classification Search
CPC ..... B61L 25/025; B61L 27/20; B61L 23/14; B61L 2027/204
(Continued)

(56) References Cited

U.S. PATENT DOCUMENTS 3,687,082 A * 8/1972 Burke, Jr. ..... B60L 15/005 104/298
7,925,380 B2 4/2011 Yu et al.
(Continued)

FOREIGN PATENT DOCUMENTS

CN 2258437 Y 7/1997
CN 101109932 A 1/2008
(Continued)

OTHER PUBLICATIONS

Office Action dated Sep. 1, 2022 for KR application No. 10-2021-0001197.

*Primary Examiner* — Krishnan Ramesh
(74) *Attorney, Agent, or Firm* — Li & Cai Intellectual Property Office

(57) ABSTRACT

An anti-collision control method and a rail vehicle control system are provided. The rail vehicle control system includes a control apparatus configured to implement the anti-collision control method to prevent a plurality of vehicles on a plurality of rails from colliding with each other. The anti-collision control method includes receiving a transfer requirement data to decide which one of the vehicles and which one of the rails are respectively an assigned vehicle and an assigned rail; planning a movement path and a movement space according to the transfer requirement data and a vehicle dimension data; determining whether any portion of the movement space is reserved; and in response to the movement space being reserved, the assigned vehicle is controlled to not move, or the movement space is reserved and the assigned vehicle is controlled to move according to the movement path along the assigned rail.

11 Claims, 18 Drawing Sheets

(58) Field of Classification Search
USPC ..... 701/19
See application file for complete search history.

(56) References Cited

U.S. PATENT DOCUMENTS

| | | | | |
|---|---|---|---|---|
| 10,410,895 | B2 | 9/2019 | Kumagai et al. | |
| 11,046,310 | B2 | 6/2021 | Yoo et al. | |
| 2004/0225421 | A1* | 11/2004 | Wu | G08G 1/20 701/19 |
| 2012/0126065 | A1* | 5/2012 | Smith | B61L 3/006 246/167 R |
| 2016/0054144 | A1* | 2/2016 | Wu | G01C 21/343 701/533 |
| 2018/0208404 | A1 | 7/2018 | Kumagai et al. | |
| 2018/0362057 | A1* | 12/2018 | Golden | G05D 1/0293 |
| 2019/0064835 | A1* | 2/2019 | Hoofard | B60T 7/22 |
| 2019/0106108 | A1* | 4/2019 | Wienecke | B60R 11/04 |
| 2019/0361464 | A1 | 11/2019 | Ahnell | |
| 2021/0047134 | A1 | 2/2021 | Takahara | |
| 2021/0188333 | A1* | 6/2021 | Angel | B61L 15/0072 |

FOREIGN PATENT DOCUMENTS

| | | | |
|---|---|---|---|
| CN | 102190075 | A | 9/2011 |
| CN | 107291076 | A | 10/2017 |
| CN | 109643123 | A | 4/2019 |
| JP | 59119414 | A | 7/1984 |
| JP | 32908 | A | 1/1991 |
| JP | 566822 | A | 3/1993 |
| JP | 2002370832 | A | 12/2002 |
| JP | 2005284779 | A | 10/2005 |
| JP | 201067144 | A | 3/2010 |
| KR | 19900018781 | A | 12/1990 |
| KR | 100151143 | B1 | 12/1998 |
| KR | 1020190102868 | A | 9/2019 |
| TW | 451918 | U | 8/2001 |
| TW | 201708997 | A | 3/2017 |
| TW | 201726523 | A | 8/2017 |
| TW | 201738996 | A | 11/2017 |
| TW | 201812971 | A | 4/2018 |
| TW | 201945262 | A | 12/2019 |

* cited by examiner

ANTI-COLLISION CONTROL METHOD AND RAIL VEHICLE CONTROL SYSTEM

CROSS-REFERENCE TO RELATED PATENT APPLICATION

This application claims the benefit of priority to Taiwan Patent Application No. 109133233, filed on Sep. 25, 2020. The entire content of the above identified application is incorporated herein by reference.

This application claims priority to the U.S. Provisional Patent Application Ser. No. 63/016,388 filed on Apr. 28, 2020, which application is incorporated herein by reference in its entirety.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an anti-collision control method and a rail vehicle control system, and more particularly to an anti-collision control method applicable to a rail vehicle system and a rail vehicle control system applicable to a semiconductor manufacturing field.

BACKGROUND OF THE DISCLOSURE

Numerous types of conventional rail vehicles are widely applied in various types of factory buildings to transfer objects. The rail vehicles in the factory building are connected to a central control device in a wireless communication manner, and the central control device controls the rail vehicles to move along particular rails to transfer the objects according to a user's requirement. In a conventional technique, when the central control device determines that the rail on which the rail vehicle will be moving does not have another rail vehicle moving thereon, the central control device can then control the rail vehicle to move on the rail. However, in a practical application, when the rail vehicle moves along the rail, the rail vehicle often collides with a rail vehicle moving on another rail or the object carried by the rail vehicle moving on another rail.

SUMMARY OF THE DISCLOSURE

In response to the above-referenced technical inadequacies, the present disclosure provides an anti-collision control method and a rail vehicle control system to primarily improve the issues associated with a conventional rail vehicle. For example, in a conventional technique, when a rail vehicle moves along a rail, the rail vehicle often collides with the rail vehicle moving on another rail or an object carried by the rail vehicle moving on another rail.

In one aspect, the present disclosure provides an anti-collision control method applicable in a rail vehicle control system. The rail vehicle control system includes a control apparatus, a plurality of vehicles, and a plurality of rails, the control apparatus is configured to control each of the vehicles to move along one of the rails, and the control apparatus is configured to implement the anti-collision control method to prevent the vehicles moving on the rails from colliding with each other. The anti-collision control method includes a transfer requirement receiving step, a deciding step, a path planning step, and a determining step. The transfer requirement receiving step is implemented by receiving a transfer requirement data. The deciding step is implemented by deciding which one of the vehicles to move along which one of the rails according to the transfer requirement data. One of the vehicles assigned to move along one of the rails is defined as an assigned vehicle, and at least one of the rails that the assigned vehicle is assigned to move on is defined as an assigned rail. The path planning step is implemented by planning a movement path and a movement space according to the transfer requirement data and a vehicle dimension data of the assigned vehicle. The movement space is a sum of a plurality of spaces occupied by the assigned vehicle when the assigned vehicle moves according to the movement path on the assigned rail. The determining step is implemented by determining whether any portion of the movement space is reserved. In response to any portion of the movement space being reserved, a stop step is implemented, and the stop step is implemented by controlling the assigned vehicle to not move. In response to any portion of the movement space being not reserved, a reserving step and a moving step are implemented. The reserving step is implemented by reserving the movement space, and the moving step is implemented by controlling the assigned vehicle to move according to the movement path along the at least one assigned rail. When the assigned vehicle moves to an assigned position according to the movement path, the control apparatus releases the movement space, so as to enable the movement space to be reserved.

In another aspect, the present disclosure provides a rail vehicle control system. The rail vehicle control system includes a control apparatus, a plurality of vehicles, and a plurality of rails. The control apparatus is configured to control each of the vehicles to move along one of the rails, the control apparatus is configured to implement an anti-collision control method to prevent the vehicles moving on the rails from colliding with each other, and the anti-collision control method includes a transfer requirement receiving step, a deciding step, a path planning step, and a determining step. The transfer requirement receiving step is implemented by receiving a transfer requirement data. The deciding step is implemented by deciding which one of the vehicles to move along which one of the rails according to the transfer requirement data. One of the vehicles assigned to move along one of the rails is defined as an assigned vehicle, and at least one of the rails that the assigned vehicle is assigned to move on is defined as an assigned rail. The path planning step is implemented by planning a movement path and a movement space according to at least a vehicle dimension data of the assigned vehicle. The movement space is a sum of a plurality of spaces occupied by the assigned vehicle when the assigned vehicle moves according to the movement path on the at least one assigned rail. The determining step is implemented by determining whether any portion of the movement space is reserved. In response to any portion of the movement space being reserved, a stop step is implemented, and the stop step is implemented by controlling the assigned vehicle to not move along the movement path. In response to any portion of the movement space being not reserved, a reserving step and a moving step are implemented. The reserving step is implemented by reserving the movement space. The moving step is implemented by controlling the assigned vehicle to move according to the movement path along the at least one assigned rail. When the assigned vehicle moves to an assigned position according to the movement path, the control apparatus releases the movement space, so as to enable the movement space to be reserved.

In conclusion, when planning the movement path and the movement space, the anti-collision control method and the rail vehicle control system of the present disclosure refer to the vehicle dimension data of the assigned vehicle. When the movement space is reserved, the movement space cannot be reserved again before it is released. Therefore, when the assigned vehicle moves along the assigned rail, the assigned vehicle cannot collide with other vehicles moving on an adjacent rail.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
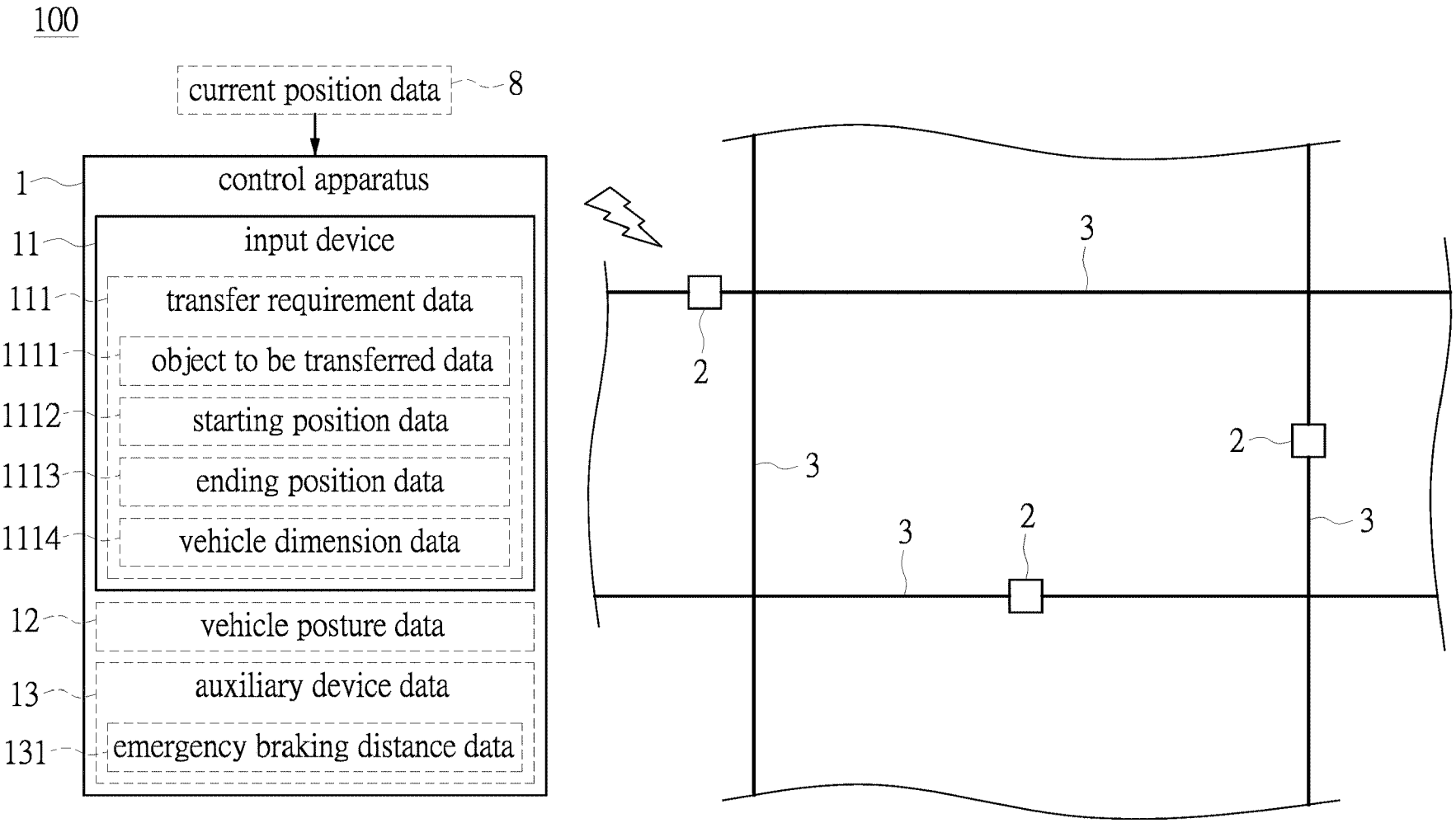
FIG. 1 is a block diagram of a rail vehicle control system of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1, FIG. 1 is a block diagram of a rail vehicle control system of the present disclosure. A rail vehicle control system 100 includes a control apparatus 1, a plurality of vehicles 2, and a plurality of rails 3. The control apparatus 1 is communicatively connected to the vehicles 2. The control apparatus 1 can be various types of computer apparatuses or servers, and the present disclosure is not limited thereto. Each of the vehicles 2 is primarily configured to transfer an object to be transferred (not shown). Each of the vehicles 2 can be controlled by the control apparatus 1 to move on at least one of the rails 3. The arrangement of each of the rails 3 can be changed according to practical requirements. For example, part of the rails 3 can only include straight sections, part of the rails 3 can include straight sections and curved sections, and part of the rails 3 can be linked to and overlapped with each other. In other words, one of the vehicles 2 can move from one of the rails 3 to another one of the rails 3. For example, the rail vehicle control system 100 can be an overhead hoist transfer (i.e., OHT) in a semiconductor manufacturing factory building or a rail transferring system for transferring a plurality of wafers, and the object to be transferred can be a front opening unified pod (i.e., FOUP), but the present disclosure is not limited thereto. It is worth mentioning that the rail vehicle control system 100 of the present disclosure can also be applicable to a magnetically guided unmanned vehicle system.

Figure 2:
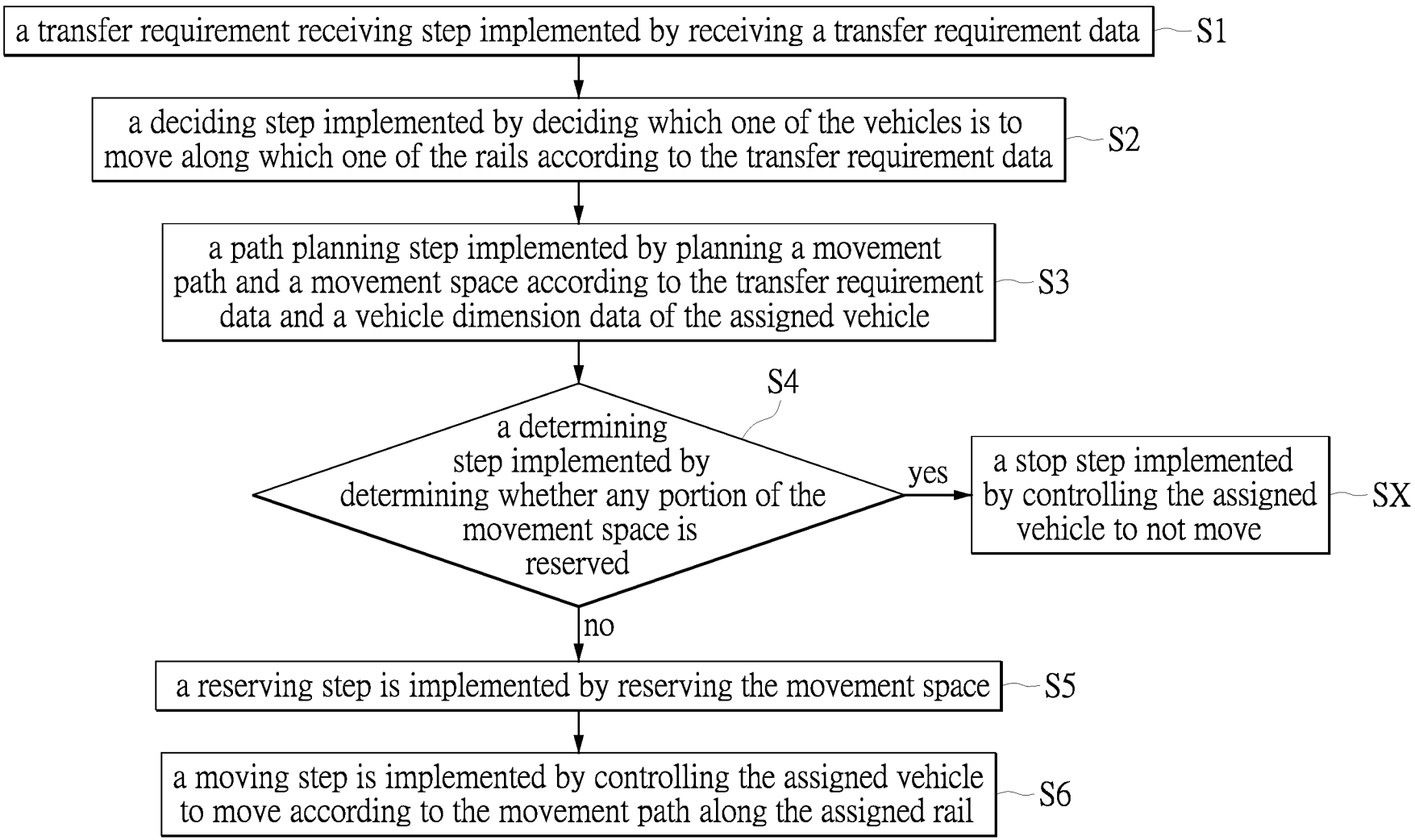
FIG. 2 is a flowchart of an anti-collision control method of the present disclosure.

The control apparatus 1 can implement an anti-collision control method of the present disclosure to prevent the vehicles 2 moving on the rails 3 from colliding with each other. Referring to FIG. 1 and FIG. 2, FIG. 2 is a flowchart of an anti-collision control method of the present disclosure. The anti-collision control method includes a transfer requirement receiving step S1, a deciding step S2, a path planning step S3, and a determining step S4. The transfer requirement receiving step S1 is implemented by receiving a transfer requirement data. The deciding step S2 is implemented by deciding which one of the vehicles 2 to move along which one of the rails 3 according to the transfer requirement data. One of the vehicles 2 that is assigned to move along one of the rails 3 is defined as an assigned vehicle, and at least one of the rails 3 that the assigned vehicle is assigned to move on is defined as an assigned rail. The path planning step S3 is implemented by planning a movement path and a movement space according to the transfer requirement data and a vehicle dimension data of the assigned vehicle. The movement space is a sum of a plurality of spaces occupied by the assigned vehicle when the assigned vehicle moves on the assigned rail according to the movement path. The determining step S4 is implemented by determining whether any portion of the movement is reserved or not.

If any portion of the movement space is reserved, a stop step SX is implemented. The stop step SX is implemented by controlling the assigned vehicle to not move.

If any portion of the movement space is not reserved, a reserving step S5 and a moving step S6 are implemented. The reserving step S5 is implemented by reserving the movement space. The moving step S6 is implemented by controlling the assigned vehicle to move along the assigned rail according to the movement path.

When the assigned vehicle moves to an assigned position according to the movement path, the control apparatus releases the movement space, so that the movement space can be reserved again.

In a practical application, in the transfer requirement receiving step S1, the control apparatus 1 can receive the transfer requirement data transmitted by an external electronic apparatus (e.g., various types of computers, servers, smart phones, or tablets) in a wireless or wired manner, or the control apparatus 1 can also include an input device 11, and according to an operation of a user, the input device 11 can correspondingly generate a transfer requirement data 111.

The transfer requirement data 111 can include an object to be transferred data 1111, a starting position data 1112, and an ending position data 1113. The object to be transferred data 1111 can include a length, a width, a height, an object code, and an object type of the object to be transferred. The starting position data 1112 can be a position (e.g., a three-dimensional coordinate) where the object to be transferred is currently arranged, and the ending position data 1113 can be a three-dimensional coordinate of a position where the object to be transferred needs to be transferred. In other embodiments, the starting position data 1112 and the ending position data 1113 can be two three-dimensional coordinates of two working stations.

In the deciding step S2, the control apparatus 1 can decide which one of the vehicles 2 is suitable to transfer the object to be transferred according to the object to be transferred data 1111. Afterwards, the control apparatus 1 can determine whether any idle vehicle 2 is near a starting position according to the starting position data 1112 and decide the idle vehicle nearest to the starting position as the assigned vehicle. Finally, the control apparatus 1 can decide which one or which ones of the rails 3 to be the assigned rail/rails according to the starting position data 1112, the ending position data 1113, and a current position of the assigned vehicle. In a practical application, various types of vehicles 2 having different dimensions and structures can be disposed in a factory building, and in the deciding step S2, the control apparatus 2 can decide which type of the vehicle as the assigned vehicle according to the dimension and the structure of the object to be transferred.

In a practical application, the transfer requirement data 111 can include a vehicle dimension data 1114, but the present disclosure is not limited thereto. In other embodiments, the control apparatus 1 can find out the vehicle dimension data 1114 from a related data base according to the transfer requirement data 111 in the deciding step S2. In other words, a technical personnel can only input the data about the object to be transferred, the starting position, and the ending position through the input device 11, and the control apparatus 1 correspondingly generates the transfer requirement data 111 mentioned above according to the data input by the technical personnel through the input device 11.

Figure 3:
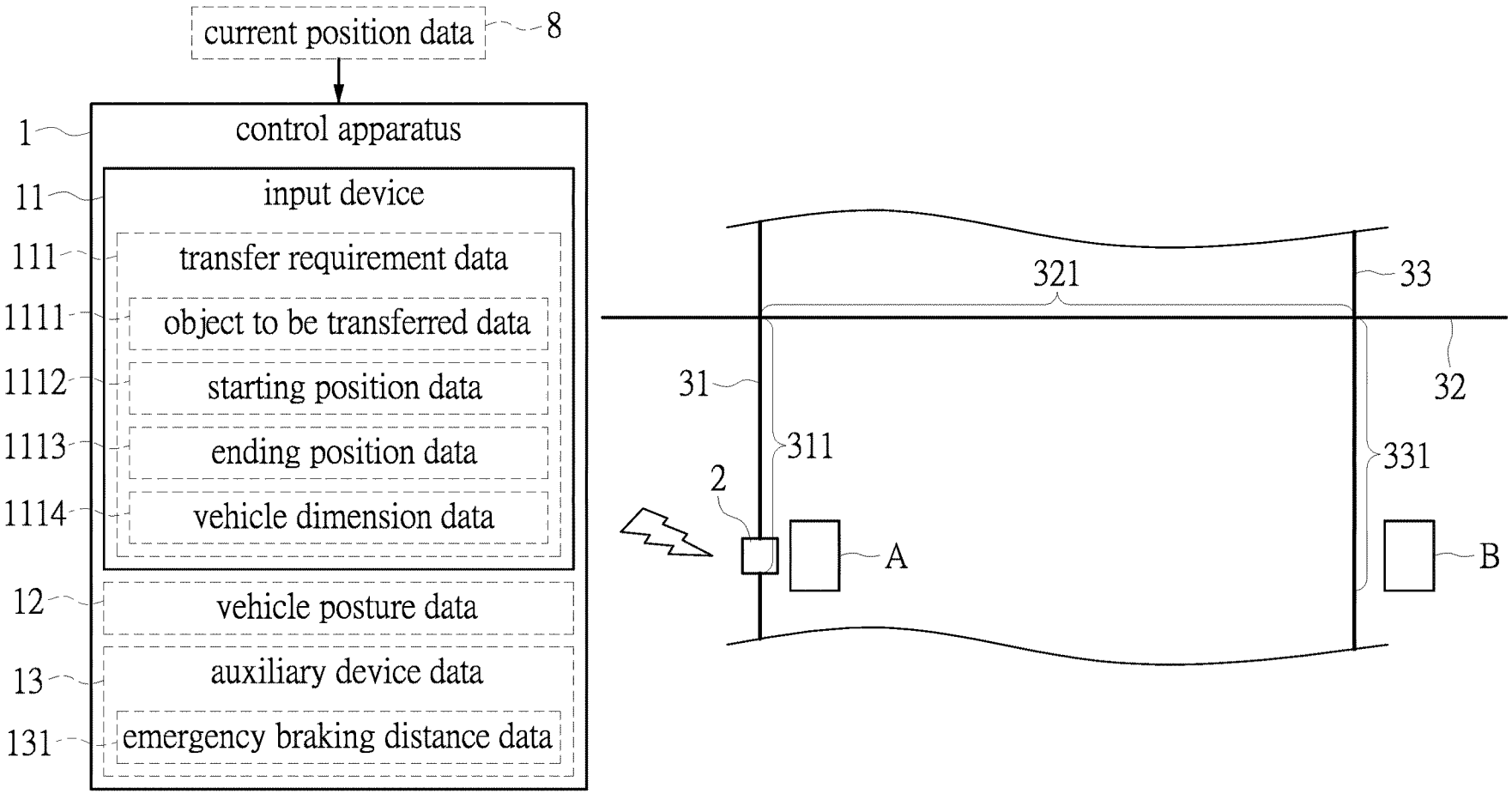
FIG. 3 is top view of a vehicle, a plurality of rails, and a movement space of an embodiment according to the present disclosure.

Referring to FIG. 2 and FIG. 3, FIG. 3 is top view of a vehicle, a plurality of rails, and a movement space of an embodiment according to the present disclosure. If the transfer requirement data 111 received by the control apparatus 1 requires the vehicle 2 to move to a position near a working station A to carry the object to be transferred and then transfer the object to be transferred to a position near a working station B, when the control apparatus 1 implements the deciding step S2, a rail 31, a rail 32, and a rail 33 can be assigned to be the assigned rails, and when the control apparatus 1 implements the path planning step S3, the control apparatus 1 decides a section 311 of the rail 31, a section 321 of the rail 32, and a section 331 of the rail 33 to be the movement path. When the control apparatus 1 implements the moving step S6, the assigned vehicle 2 is controlled to move to the position near the working station A, and then the control apparatus 1 controls a robot arm or a related transferring apparatus of the working station A to load the object to be transferred onto the assigned vehicle 2. Afterwards, the control apparatus 1 controls the assigned vehicle 2 loaded with the object to be transferred to start moving from the position near the working station A along the section 311 of the rail 31, the section 321 of the rail 32, and the section 331 of the rail 33 to the position near the working station B. When the assigned vehicle 2 moves to the position near the working station B, the control apparatus 1 controls the related transferring apparatus (e.g., the robot arm) of the working station B to unload the object to be transferred from the assigned vehicle 2.

It is worth mentioning that the control apparatus 1 can further include a display device (e.g., various types of screens), and the technical personnel can view which one of the above steps is currently being implemented by the control apparatus 1 through the display device. For example, when the control apparatus 1 implements the transfer requirement receiving step S1, the technical personnel can view a content included by the transfer requirement data through an image shown by the display device. When the control apparatus 1 implements the deciding step S2, the technical personnel can see a rail distribution diagram, a plurality of vehicle positions in the factory building, which ones of the rails are the assigned rails, and which one of the vehicles is the assigned vehicle through the image shown by the display device.

Figure 4:
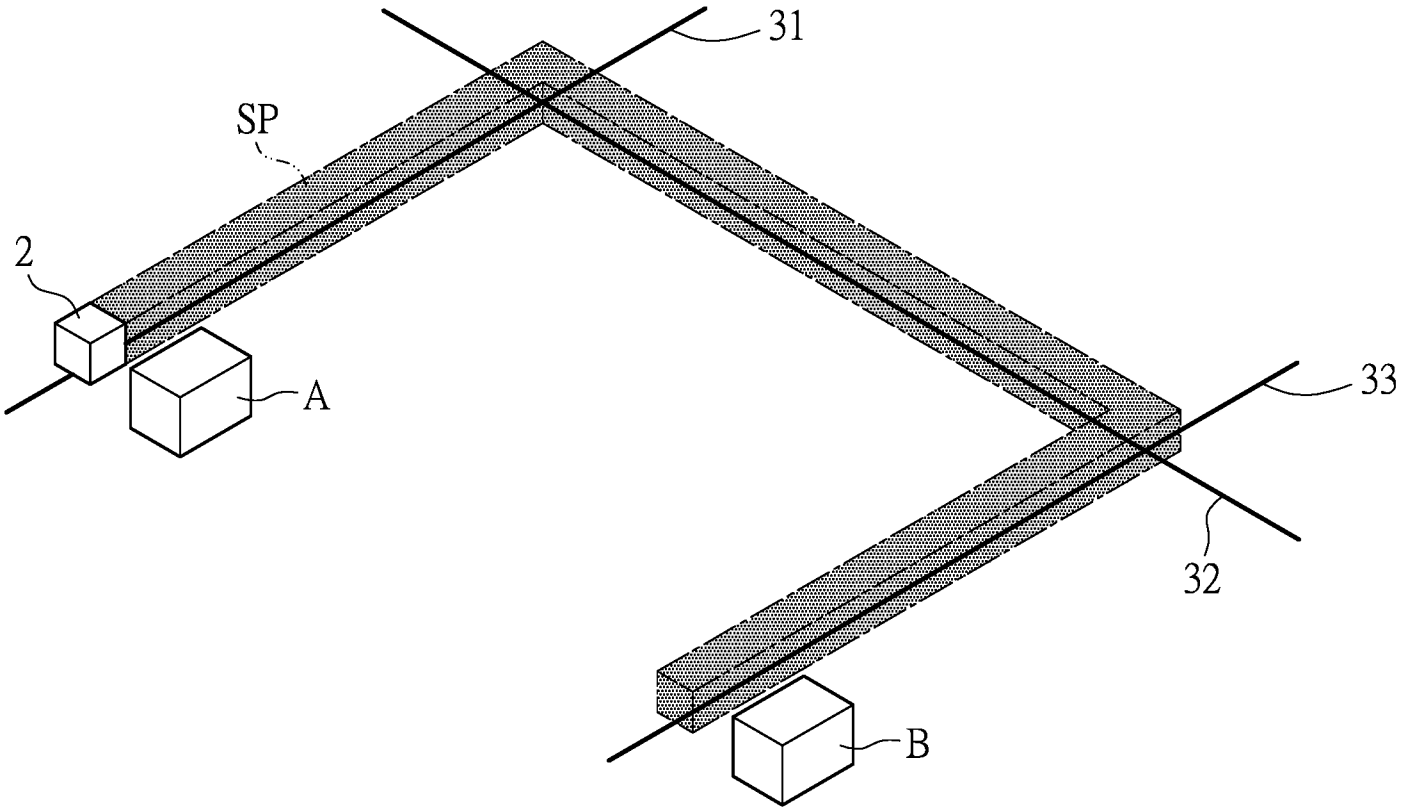
FIG. 4 is a perspective view of the vehicle, the rails, and the movement space of an embodiment according to the present disclosure.
Figure 5:
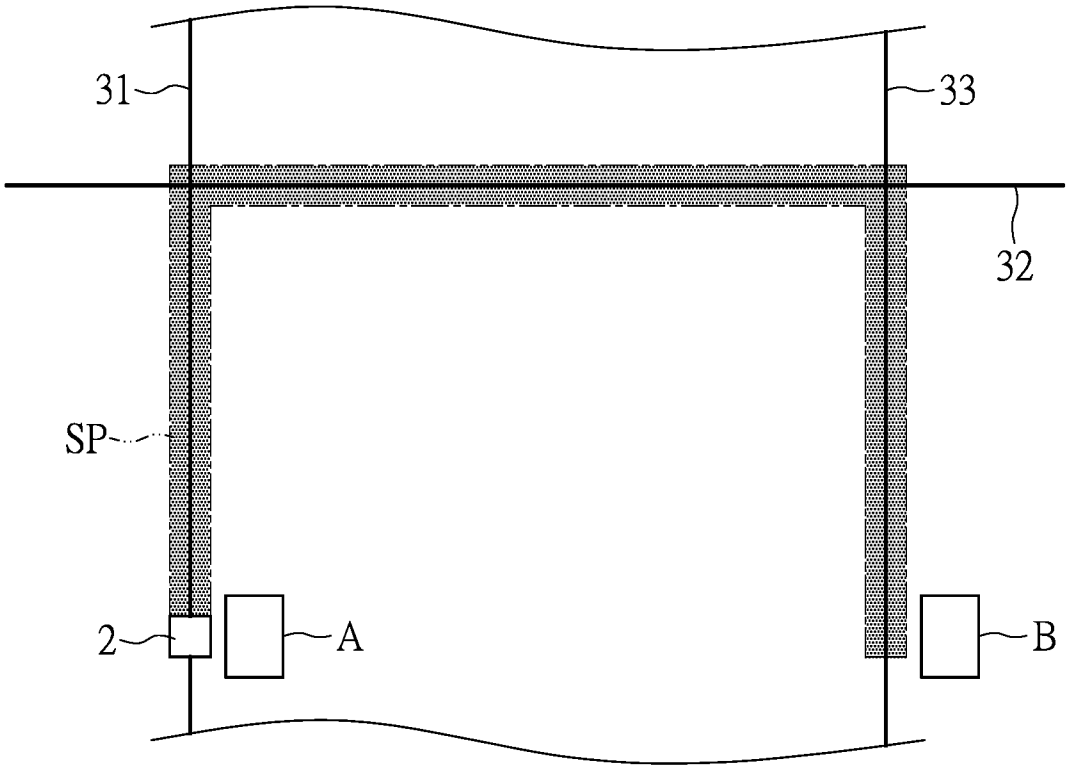
FIG. 5 and FIG. 6 are respectively top views of the vehicle, the rails, and the movement space of an embodiment according to the present disclosure.

Referring to FIG. 3 to FIG. 5, FIG. 4 is a perspective view of the vehicle, the rails, and the movement space of an embodiment according to the present disclosure, and FIG. 5 is a top view of the vehicle, the rails, and the movement space of an embodiment according to the present disclosure. A movement space SP mentioned in the path planning step S3 is a sum (i.e., an area illustrated with a plurality of dots in FIG. 4 and FIG. 5) of a plurality of spaces occupied by the vehicle 2 in the three-dimension space when the vehicle 2 moves along the section 311 of the assigned rail 31, the section 321 of the assigned rail 32, the section 331 of the assigned rail 33 from the position near the working station A to the working station B.

In a practical application, when the control apparatus 1 plans the movement space SP, in addition to the vehicle dimension data 1114, the control apparatus 1 can determine a moving manner of the vehicle 2 in a real space further according to the data about the movement path and the assigned rail so as to plan the movement space SP of the vehicle 2 that fits the moving manner of the vehicle 2 in the real space. More specifically, as shown in FIG. 4 and FIG.

5, in a process where the vehicle 2 moves from the position near the working station A to the position near the working station B along the rail 31, the vehicle 2 turns twice. When the control apparatus 1 plans the movement space SP, the control apparatus 1 calculates a turning angle in each of two turning processes of the vehicle 2 according to the movement path and the vehicle dimension data 1114, and then the control apparatus 1 finishes planning the corresponding movement space SP.

In other words, in an embodiment of the present disclosure, the path planning step S3 of the anti-collision control method of the present disclosure is applicable to the assigned rail having turning sections, and when the control apparatus 1 implements the path planning step S3, the control apparatus 1 further determines whether the vehicle 2 turns when the vehicle 2 moves along the assigned rail. If the control apparatus 1 determines that the vehicle 2 turns when moving along the assigned rail, the control apparatus 1 can particularly perform extra planning and calculation to the turning section when the control apparatus 1 plans the movement space SP, so that the planned movement space SP is more suitable with the spaces actually occupied by the vehicle 2 when moving along the assigned rail.

Figure 6:
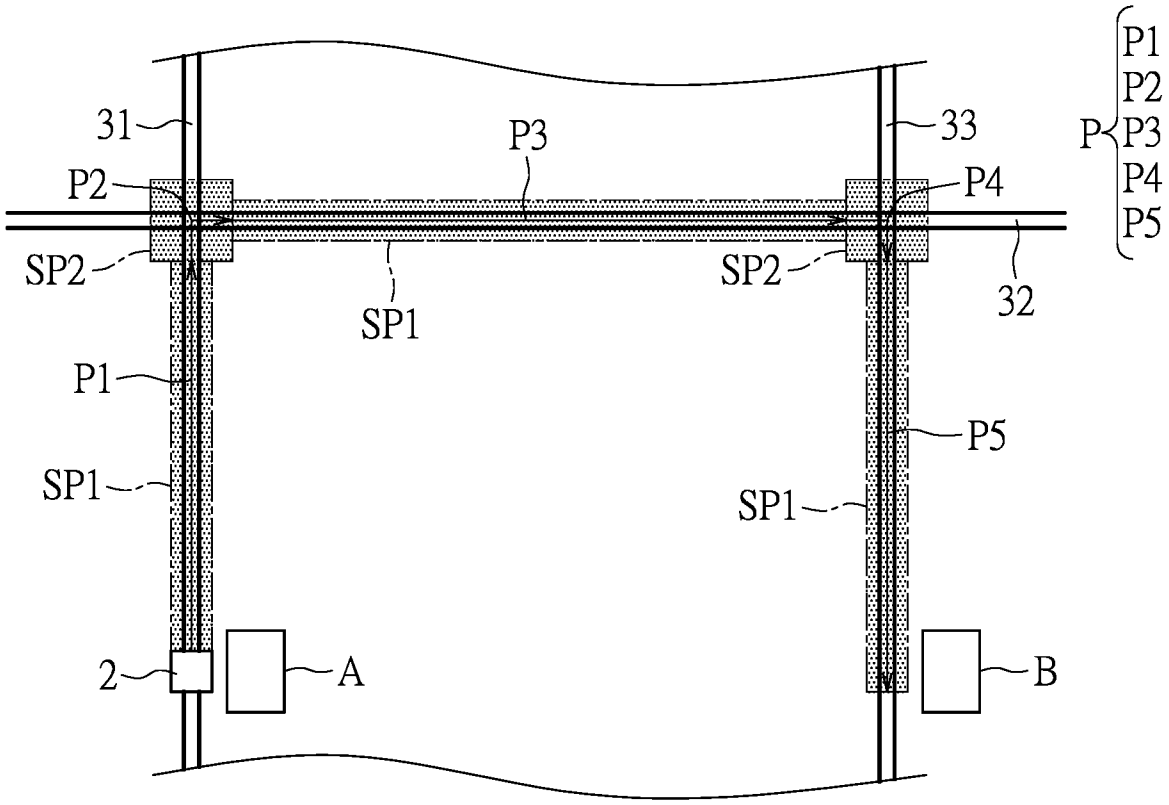

The manner in which the control apparatus 1 performs the extra planning and calculation when the control apparatus 1 determines that the vehicle 2 turns when moving is not limited in the present disclosure and can be designed according to practical requirements. For example, FIG. 6 is a top view of the vehicle, the rails, and the movement space of another embodiment according to the present disclosure. If the control apparatus 1 determines that the vehicle 2 turns when moving along the assigned rail, the control apparatus 1 can separately plan a straight section P1, a straight section P3, and a straight section P5 of a movement path P and a turning section P2 and a turning section P4 of the movement path P when the control apparatus 1 plans the movement space. The control apparatus 1 can plan the straight section P1, the straight section P3, and the straight section P5 of the movement path P according to a length, a width, and a height of the vehicle 2. The control apparatus 1 can plan the turning section P2 and the turning section P4 of the movement path P according to 200% of the length, 200% of the width, and 100% of the height of the vehicle, but the present disclosure is not limited thereto. In this way, the planned movement space can be ensured to cover a range that the vehicle 2 occupies when moving either straight or turning in a real situation. According to the above, the control apparatus 1 eventually plans two movement spaces (i.e., a movement space SP1 and a movement space SP2), an occupied range of the movement space SP1 is substantially equal to the dimension of the vehicle 2, and an occupied space SP2 is greater than the dimension of the vehicle to cover the space occupied by the vehicle 2 when turning.

Figure 7:
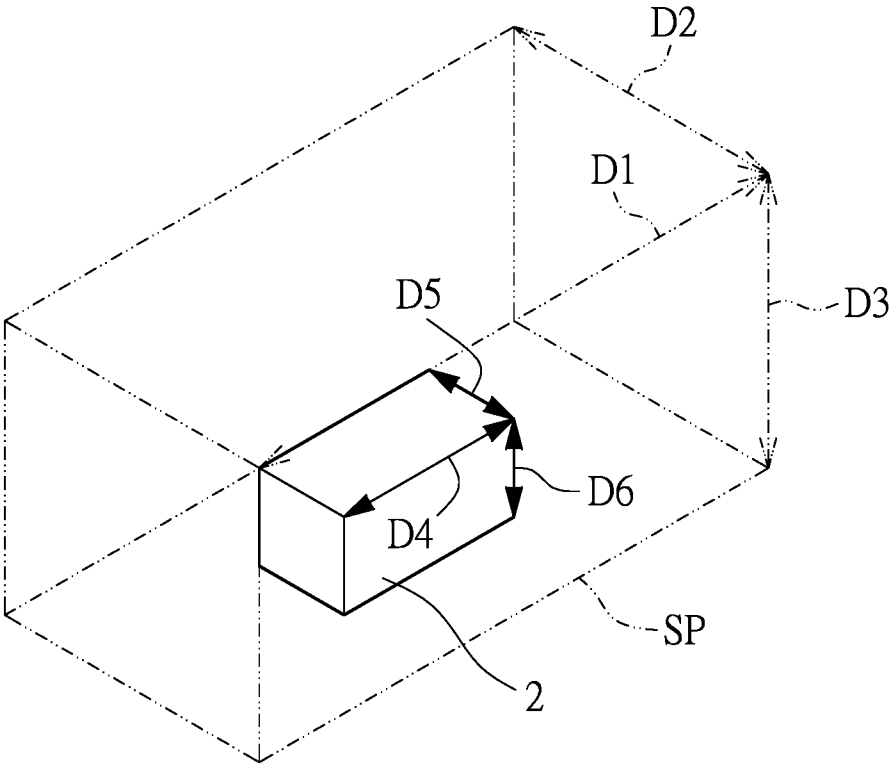
FIG. 7 is a perspective view of the vehicle and a unit of the movement space of the present disclosure.

Referring to FIG. 7, FIG. 7 is a perspective view of the vehicle and a unit of the movement space of the present disclosure. In other embodiments, when the control apparatus 1 implements the path planning step S3, a stationary assigned vehicle 2, a length D1, a width D2, and a height D3 of the movement space SP planned by the control apparatus 1 are respectively greater than a predetermined multiple of a length D4, a predetermined multiple of a width D5, and a predetermined multiple of a height D6 of the assigned vehicle 2. A practical value of the predetermined multiple can be designed according to practical requirements, and the present disclosure is not limited thereto. In other words, a volume of the movement space SP planned by the control apparatus 1 is greater than a volume that the assigned vehicle 2 actually occupies. In this way, it can be better ensured that the assigned vehicle 2 cannot easily collide with another vehicle when the assigned vehicle 2 moves along the movement path.

In a practical application, a multiplicative relationship between the length D1 of the movement space SP and the length D4 of the assigned vehicle 2, a multiplicative relationship between the width D2 of the movement space SP and the width D5 of the assigned vehicle 2, and a multiplicative relationship between the height D3 of the movement space SP and the height D6 of the assigned vehicle 2 can be entirely the same, partially the same, or entirely different. For example, the length D1, the width D2, and the height D3 can be respectively 150% of the length D4, 150% of the width D5, and 150% of the height D6, or the length D1, the width D2, and the height D3 can be respectively 150% of the length D4, 150% of the width D5, and 100% of the height D6, or the length D1, the width D2, and the height D3 can be respectively 150% of the length D4, 200% of the width D5, and 100% of the height D6.

Figure 8:
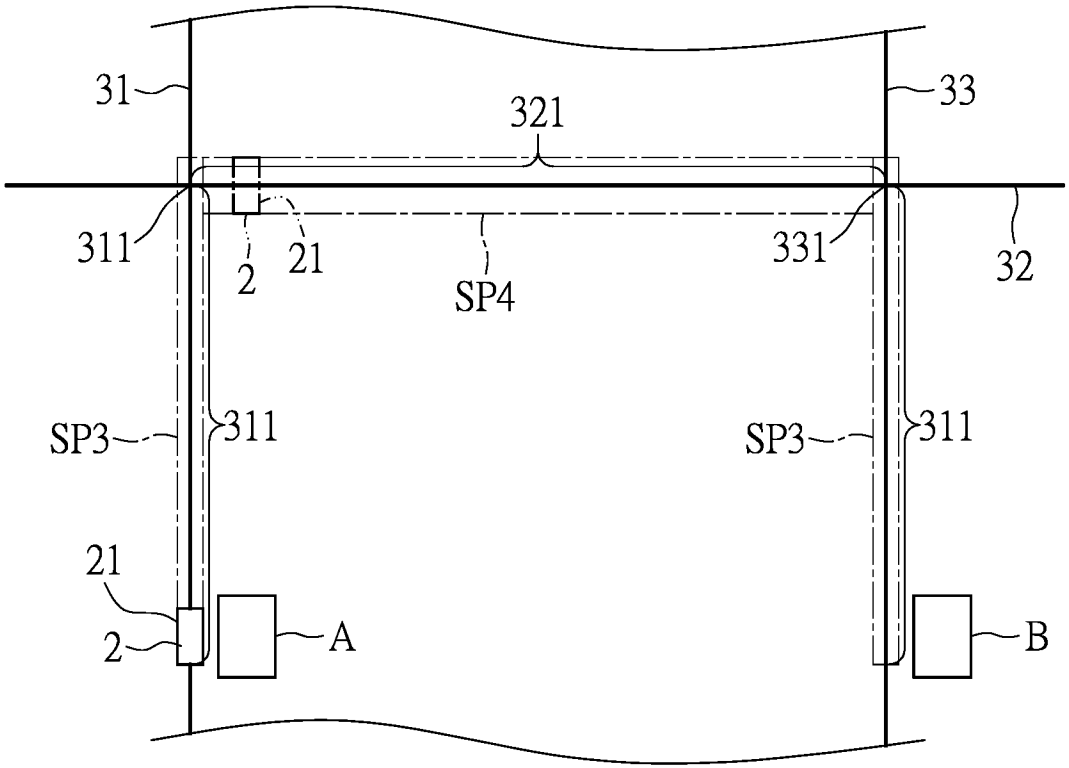
FIG. 8 to FIG. 17 are respectively top views of the vehicles, the rails, and the movement spaces of a plurality of embodiments according to the present disclosure.

Referring to FIG. 1 and FIG. 8, FIG. 8 is a top view of the vehicle, the rails, and the movement spaces of an embodiment according to the present disclosure. As shown in FIG. 1, the control apparatus 1 can plan the movement space SP according to the vehicle dimension data 1114, the movement path, and a vehicle posture data 12. More specifically, when the vehicle 2 moves along the rail 3 in the factory building, the vehicle 2 must move in different postures according to arranged positions of some machines in the factory building to prevent the vehicle 2 itself from colliding with the machines around the rail 3. For example, as shown in FIG. 8, when the vehicle 2 moves along the section 311 of the rail 31, a long side 21 of the vehicle 2 is substantially parallel to the rail 31, and when the vehicle 2 moves along the section 321 of the rail 32, the long side 21 of the vehicle 2 is changed, such that the vehicle 2 is substantially perpendicular to the rail 32. In this embodiment, the movement space planned by the control apparatus 1 includes two first spatial sections SP3 and a second spatial section SP4, the first spatial sections SP3 are planned according to a vehicle posture in which the long side 21 of the vehicle 2 is substantially parallel to the rail 31, and the second spatial section SP4 is planned according to a vehicle posture in which the long side 21 of the vehicle 2 is substantially perpendicular to the rail 32.

Figure 9:
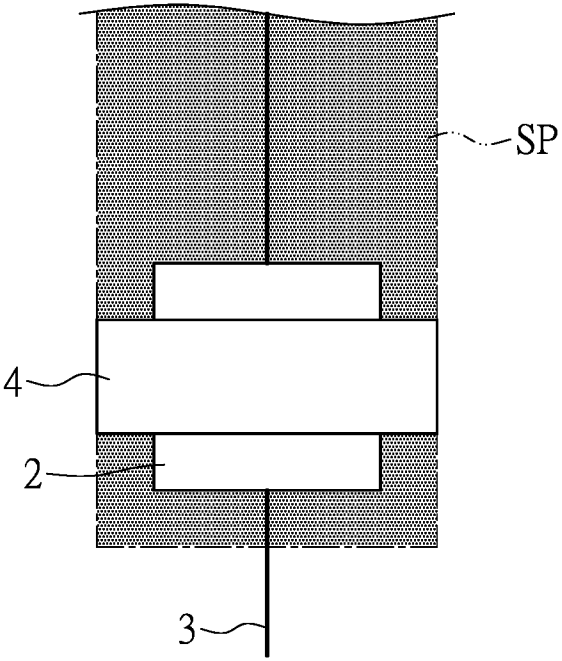

Referring to FIG. 1 and FIG. 9, FIG. 9 is a top view of the vehicle, the rail, and the movement space of an embodiment according to the present disclosure. In other embodiments, in the path planning step S3, the control apparatus 1 can plan the movement path and the movement space SP according to both the object to be transferred data 1111 and the vehicle dimension data 1114. More specifically, when the object to be transferred 4 is disposed on the vehicle 2, a portion of the object to be transferred may protrude from at least one of a length direction, a width direction, and a height direction of the vehicle 2. Therefore, the control apparatus 1 can plan the movement path and the movement space SP according to both the vehicle dimension data 1114 and the object to be transferred data 1111, and the movement space SP planned by the control apparatus 1 is a sum of a plurality of spaces occupied by the assigned vehicle and the object to be transferred 4 disposed on the assigned vehicle when they are moving along the assigned rail.

In a practical application, a distance between each of the rails and other apparatuses in the factory building may not be uniform. Therefore, in an embodiment of the present disclosure, the object to be transferred 4 protrudes from the vehicle 2, and if the control apparatus 1 does not refer to both the object to be transferred data 1111 and the vehicle dimension data 1114 when planning the movement path and the movement space SP, the vehicle 2 and the object to be transferred 4 carried thereon may collide with related apparatuses around the assigned rail when the vehicle 2 and the object to be transferred 4 carried thereon move along the assigned rail. Naturally, if the space in the factory building is relatively large, the control apparatus 1 can plan the movement path and the movement space SP without referring to the object to be transferred data 1111.

In other embodiments, when the control apparatus 1 implements the path planning step S3, the control apparatus 1 can plan the movement space according to whether the vehicle 2 carries the object to be transferred 4 at different road sections of the movement path. In other words, the movement space planned by the control apparatus 1 at the road sections where the vehicle 2 carries the object to be transferred may be greater than the movement space planned by the control apparatus 1 at the road sections where the vehicle 2 does not carry the object to be transferred.

Figure 10:
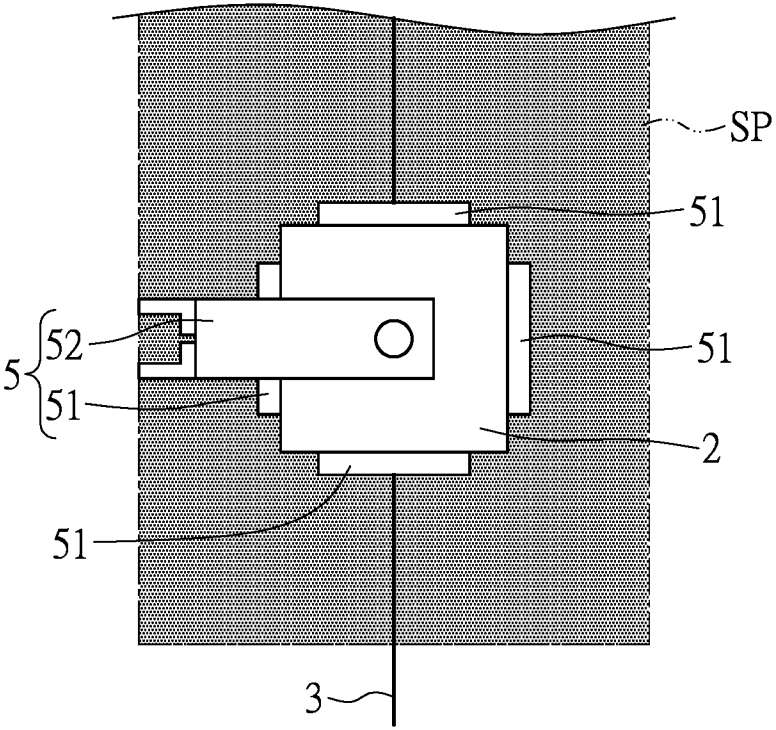

Referring to FIG. 1 and FIG. 10, FIG. 10 is a top view of the vehicle, the rail, and the movement space of an embodiment according to the present disclosure. As shown in FIG. 1 and FIG. 10, when the control apparatus 1 implements the path planning step S3, the control apparatus 1 can plan the movement path and the movement space SP according to at least the vehicle dimension data 1114 of the assigned vehicle and an auxiliary device data 13. The movement space SP is a sum of a plurality of spaces occupied by the assigned vehicle and an auxiliary device 5 disposed on the assigned vehicle when they are moving according to the movement path along the assigned rail 3. The auxiliary device data 13 includes at least a dimension data (e.g., a length, a width, and a height) of the auxiliary device 5, and the auxiliary device data 13 can be stored in a data base of the control apparatus 1 or a related storage device in advance.

The auxiliary device 5 mentioned herein can be any device, member, or structure that is disposed on and protruding from the vehicle 2. In other words, the auxiliary device 5 is any device, member, or structure that increases the width, length, or height of the vehicle 2. For example, the auxiliary device 5 can include at least one of a detector 51 and a holding structure 52. The detector 51 is configured to detect a surrounding environment of the vehicle 2, and the holding structure 52 is configured to hold and transfer the object to be transferred (not shown). The detector 51 can be, for example, a laser transmitter, a laser receiver, an ultrasonic transmitter, or an ultrasonic receiver, and any electronic component configured to help the vehicle 2 determine whether the surrounding environment of the vehicle 2 falls within the applicable range of the detector 51. The holding structure 52 can be, for example, various types of robot arms, and the present disclosure is not limited thereto. Any related component configured to hold the object to be transferred falls within the applicable range of the holding structure 52.

It is worth mentioning that in other embodiments, the auxiliary device data 13 can further include an emergency braking distance data 131 (as shown in FIG. 1). When the vehicle 2 moves along the rail 3, the detector 51 selectively controls the vehicle 2 to stop moving according to the emergency braking distance data 131 so as to prevent the vehicle 2 from colliding with any unexpected objects. For example, when the detector 51 detects that any object is within 50 cm (i.e., an emergency braking distance) in front of any side of the vehicle 2, the detector 51 can control the vehicle 2 to stop. Therefore, in an embodiment of the present disclosure, the auxiliary device data 13 includes the emergency braking distance data 131, and the control apparatus 1 further refers to the emergency braking distance data 131 when planning the movement space SP, thereby preventing the detector 51 from controlling the vehicle 2 to stop when the detector 51 detects any object that is not on the rail in a process where the vehicle 2 moves along the movement path.

Figure 11:
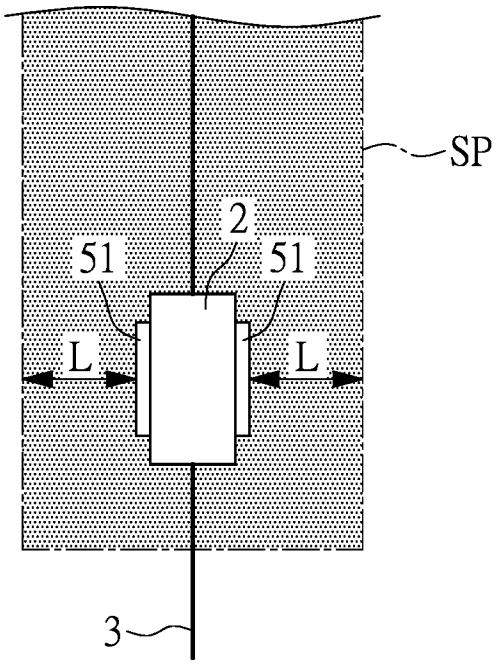

For example, referring to FIG. 11, FIG. 11 is a top view of the vehicle, the rail, and the movement space of an embodiment according to the present disclosure. A range covered by the movement space SP planned by the control apparatus 1 along a non-travel direction of the vehicle 2 is greater than an emergency braking distance L of the detector 51. In this way, when the movement space SP is reserved and the vehicle 2 moves along the movement path, the movement space SP is reserved, so that another vehicle 2 cannot reserve the movement space SP. Therefore, the detector 51 disposed on the vehicle 2 cannot detect another vehicle 2 within the emergency braking distance L in the non-travel direction of the vehicle 2.

Figure 12:
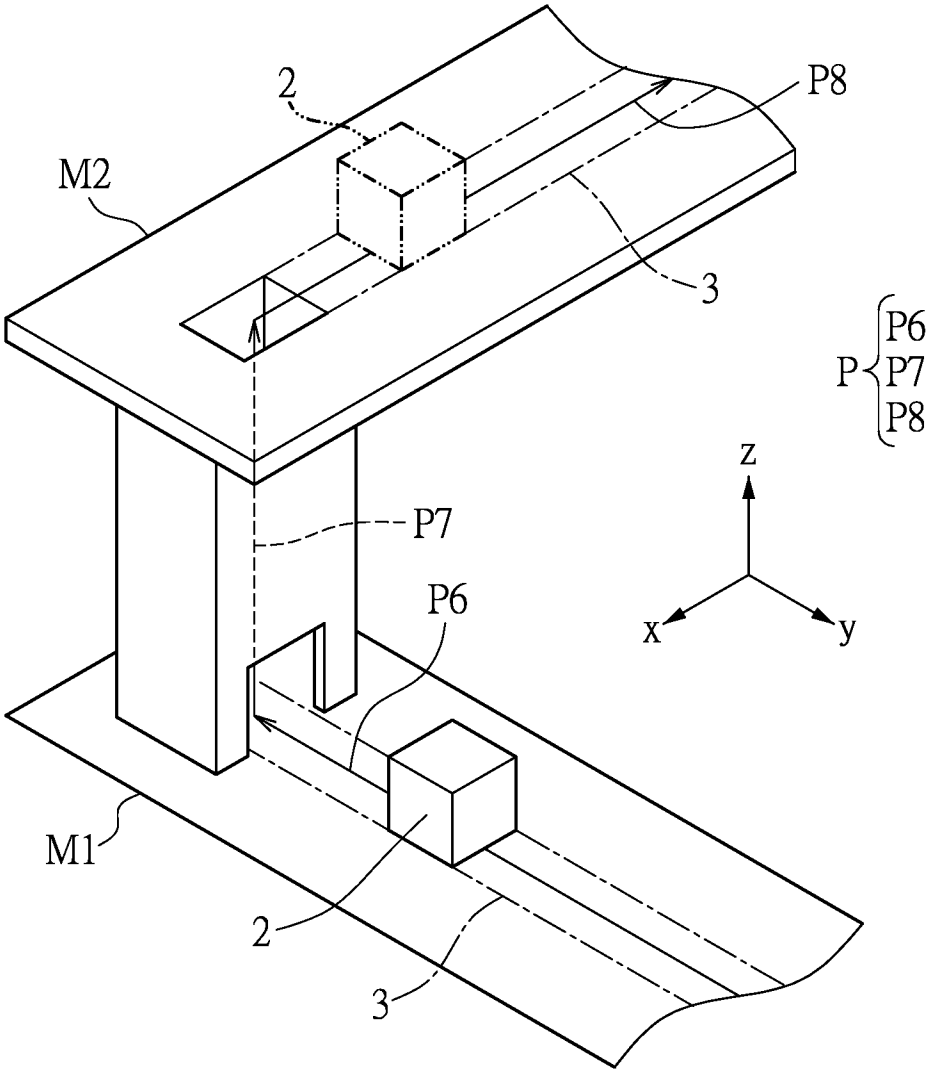

Referring to FIG. 12, it should be noted that in other embodiments, the movement path P can include a first plane road section P6, a longitudinal road section P7, and a second plane road section P8. Firstly, the vehicle 2 can move at a first plane M1 (i.e., one of a plurality of planes parallel to an X-Y plane in FIG. 12), and then the vehicle 2 can move along a longitudinal direction (i.e., a z-axis direction in FIG. 12). Finally, the vehicle 2 can move at a second plane M2 (i.e., one of a plurality of planes parallel to the X-Y plane in FIG. 12). The first plane M1 and the second plane M2 can be at different floors or at different heights of a same floor. The rail 3 can be longitudinally disposed, so that the vehicle 2 can move along the longitudinal section P7, or, the vehicle 2 can enter a structure similar to an elevator and move longitudinally with the elevator.

Figure 13:
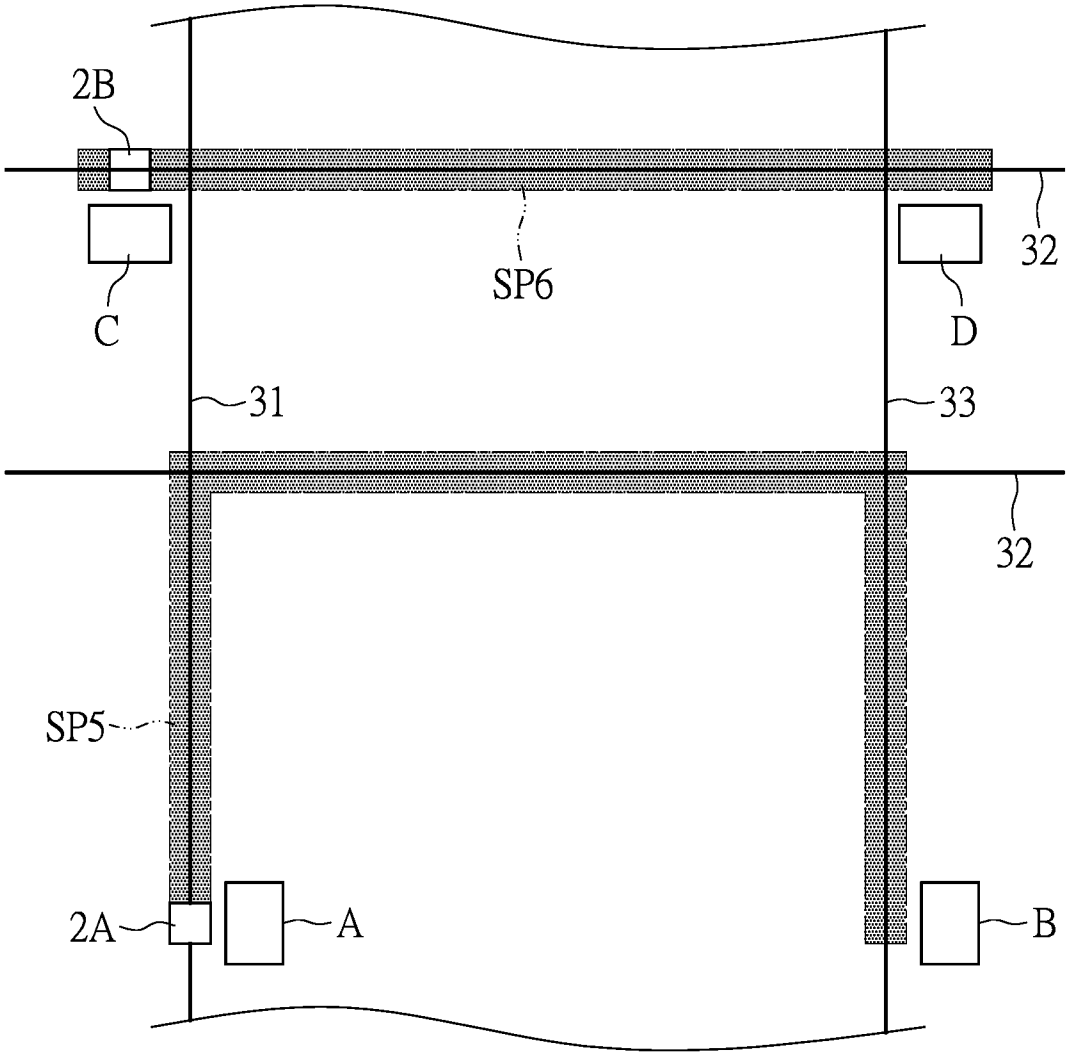

Referring to FIG. 13, FIG. 13 is a top view of the vehicles, the rails, and the movement spaces of an embodiment according to the present disclosure. When the control apparatus 1 implements the determining step S4 to determine whether a movement space SP5 occupied by an assigned vehicle 2A moving from the position near the working station A to the position near the working station 2B is reserved, if a movement space SP6 occupied by another vehicle 2B moving from a position near a working station C to a position near a working station D is reserved, the control apparatus 1 determines whether any portion of the movement space SP5 occupied by the assigned vehicle 2A moving from the position near the working station A to the position near the working station 2B overlaps with the movement space SP6 occupied by another vehicle 2B moving from the position near the working station C to the position near the working station D. If the movement space SP5 and the movement space SP6 do not overlap with each other, the control apparatus 1 can continue to implement the reserving step S5 and the moving step S6 to reserve the movement space SP5 occupied by the assigned vehicle 2A moving from the position near the working station A to the position near the working station 2B and allow the assigned vehicle 2A to move from the position near the working station A to the position near the working station 2B.

Figure 14:
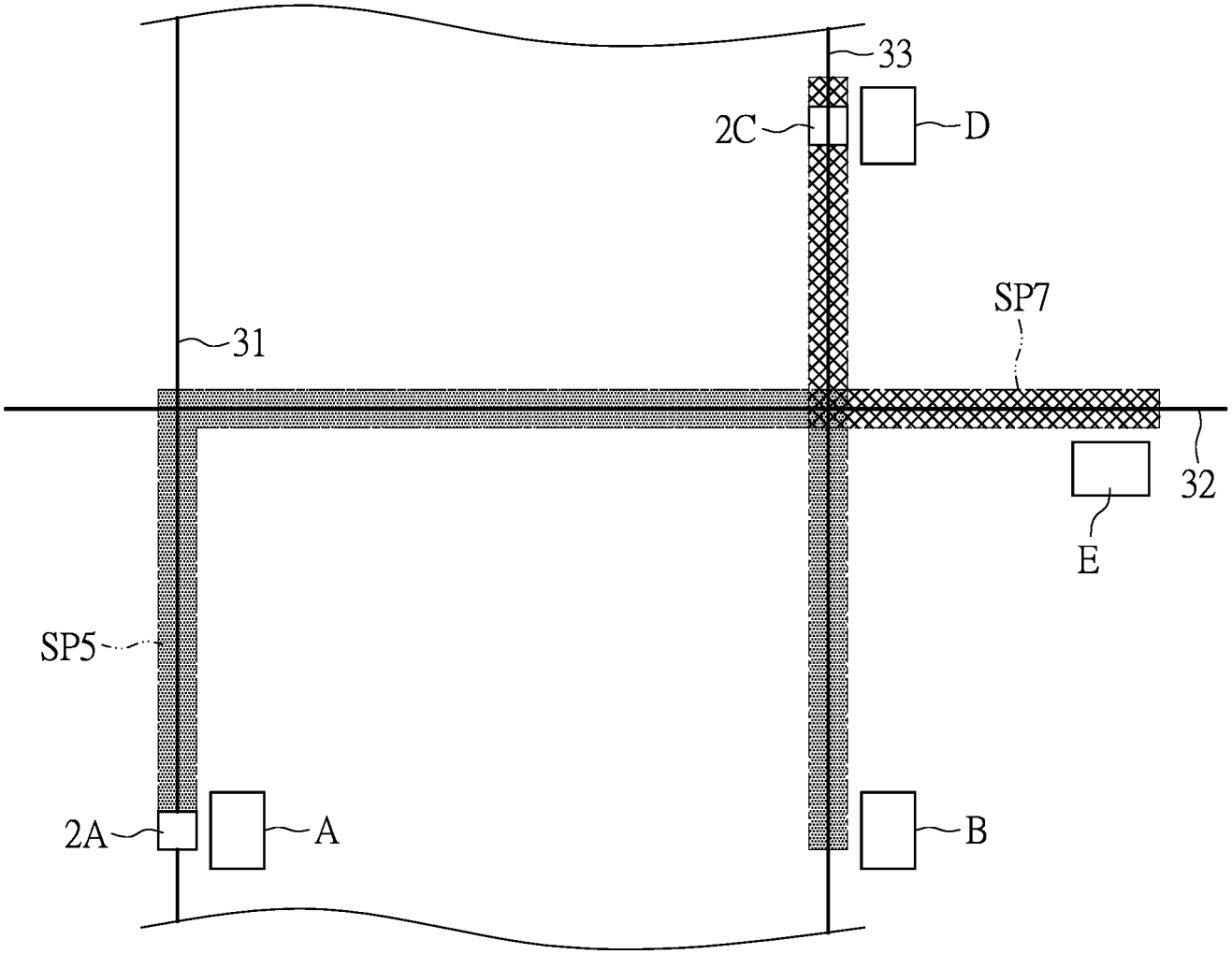

Referring to FIG. 2 and FIG. 14, FIG. 14 is a top view of the vehicles, the rails, and the movement spaces of an embodiment according to the present disclosure. When the control apparatus 1 implements the determining step S4 and determines that a portion of the movement space S5 occupied by the assigned vehicle 2A moving from the position near the working station A to the position near the working station 2B overlaps with a movement space SP7 occupied by another vehicle 2C moving from a position near a working station D to a position near a working station E (i.e., the control apparatus 1 determines that any portion of the movement space SP5 overlaps with another movement space that is reserved), the control apparatus 1 implements a stop step SX to control the assigned vehicle 2A to not move. After the control apparatus 1 implements the stop step SX, the control apparatus 1 can implement the determining step S4 again after a predetermined time period. In a practical application, when the control apparatus 1 implements the path planning step S3, the control apparatus 1 can record a time period that the assigned vehicle requires to move along the assigned rail at the same time, and the control apparatus 1 can implement the determining step S4 again at a correct time.

For example, when the control apparatus 1 determines that a portion of the movement space SP5 occupied by the assigned vehicle 2A moving from the position near the working station A to the position near the working station 2B overlaps with the movement space SP7 occupied by another vehicle 2C moving from the position near the working station D to the position near the working station E, the control apparatus 1 finds a time period required for the vehicle 2C to move from the position near the working station D to the position near the working station E in a data base. If the time period required for the vehicle 2C to move from the position near the working station D to the position near the working station E is 10 minutes, the control apparatus 1 implements the determining step S4 again 10 minutes later.

Figure 15:
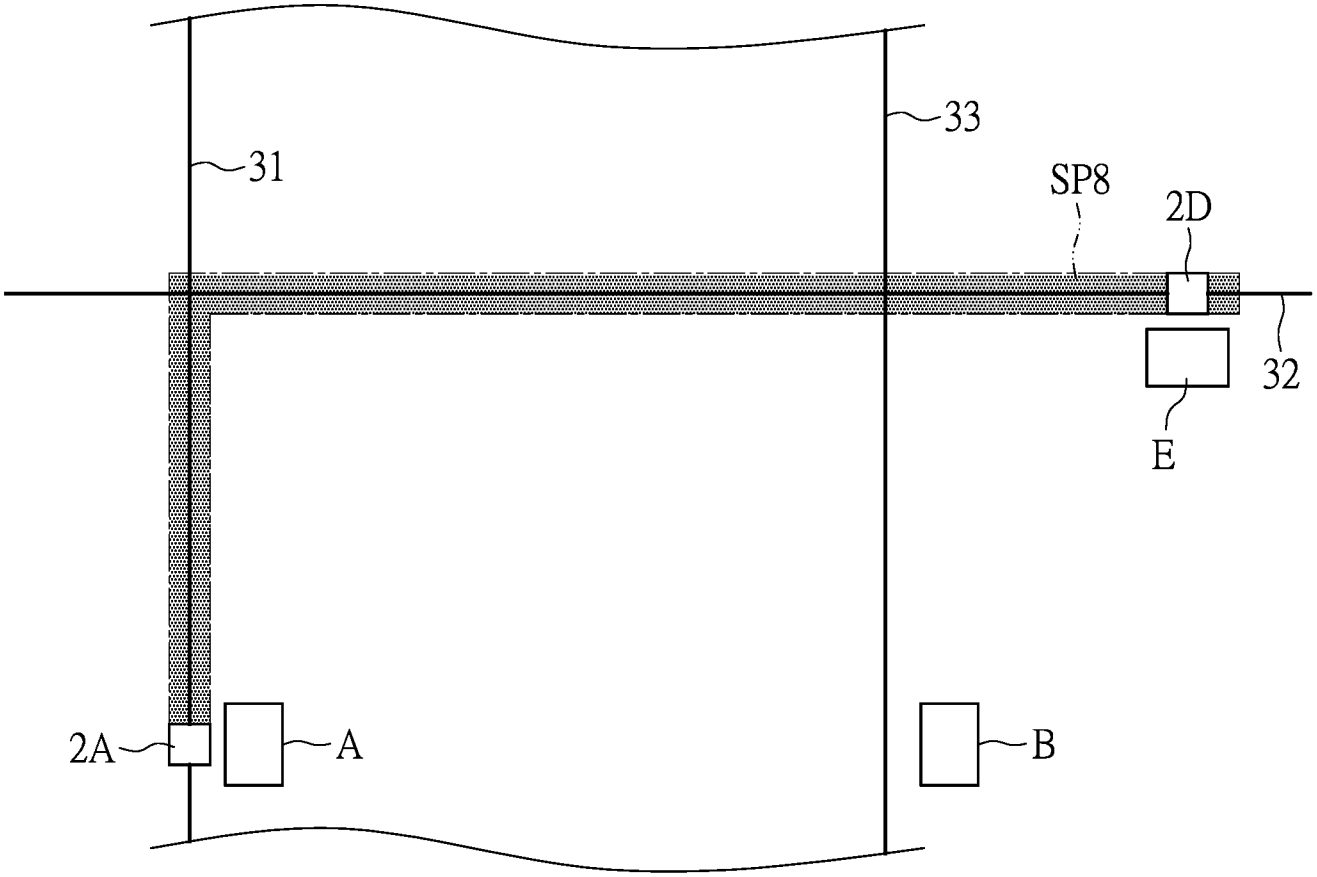

It is worth mentioning that when the control apparatus 1 implements the stop step SX, the control apparatus 1 controls the assigned vehicle to stop at the starting position, and the control apparatus 1 reserves a space occupied by the assigned vehicle at the starting position, so that another vehicle 2 cannot reserve the space. For example, referring to FIG. 15, FIG. 15 is a top view of the vehicles, the rails, and the movement space of an embodiment according to the present disclosure. If the control apparatus 1 implements the stop step SX to control the assigned vehicle to stop at the position near the working station A after implementing the determining step S4, the control apparatus 1 implements another determining step S4 to determine whether a movement space SP8 occupied by another vehicle 2D moving from the position near the working station E to the position near the working station A is reserved or not. Since the vehicle 2A stops at the position near the working station A, the control apparatus 1 determines that a portion of the movement space SP8 occupied by the vehicle 2D moving from the position near the working station E to the position near the working station A is reserved. Therefore, the control apparatus 1 implements the stop step SX.

Figure 16:
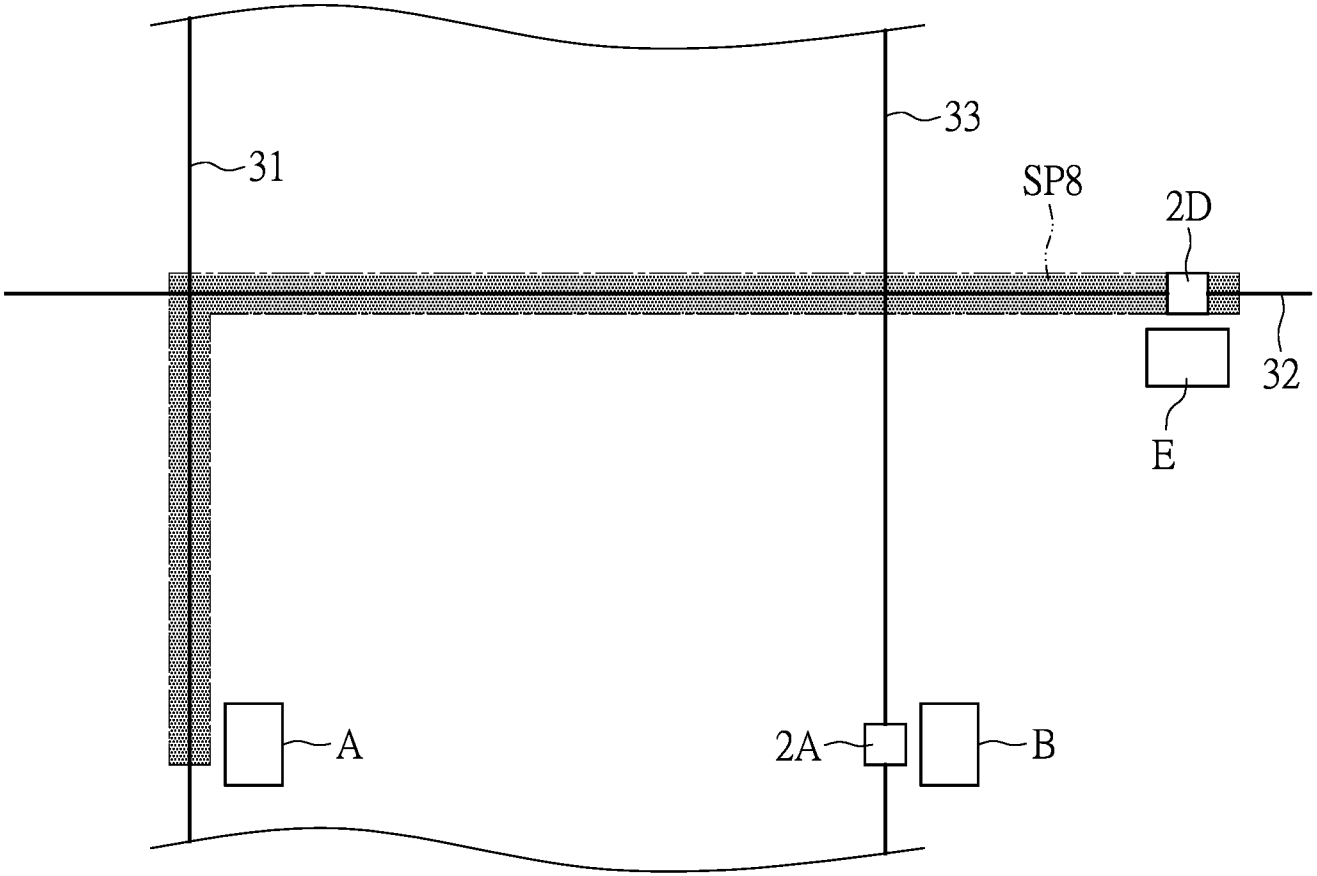

In a practical application, when the control apparatus 1 controls the assigned vehicle to move along the assigned rail to an assigned position, the control apparatus 1 releases the corresponding movement space, so that the movement space can be reserved. For example, referring to FIG. 14 and FIG. 16, FIG. 16 is a top view of the vehicles, the rails, and the movement space of an embodiment according to the present disclosure. After the assigned vehicle 2A moves from the position near the working station A to the position (i.e., the assigned position) near the working station B, the movement space SP5 originally occupied by the assigned vehicle 2A moving from the position near the working station A to the position near the working station B is no longer in a reserved state. At this time, the control apparatus 1 can reserve the movement space SP8 occupied by another vehicle 2D moving from the position near the working station E to the position near the working station A.

In a practical application, in the path planning step S3, the control apparatus 1 can record a plurality of endpoint coordinates of the movement space, and in the reserving step S5, the control apparatus 1 can record the corresponding endpoint coordinates of the movement space as a plurality of reserved coordinates. In another determining step S4, the control apparatus 1 determines whether any portion of the movement space overlaps with a reserved space according to the endpoint coordinates of the movement space and the reserved coordinates through program calculation.

Figure 17:
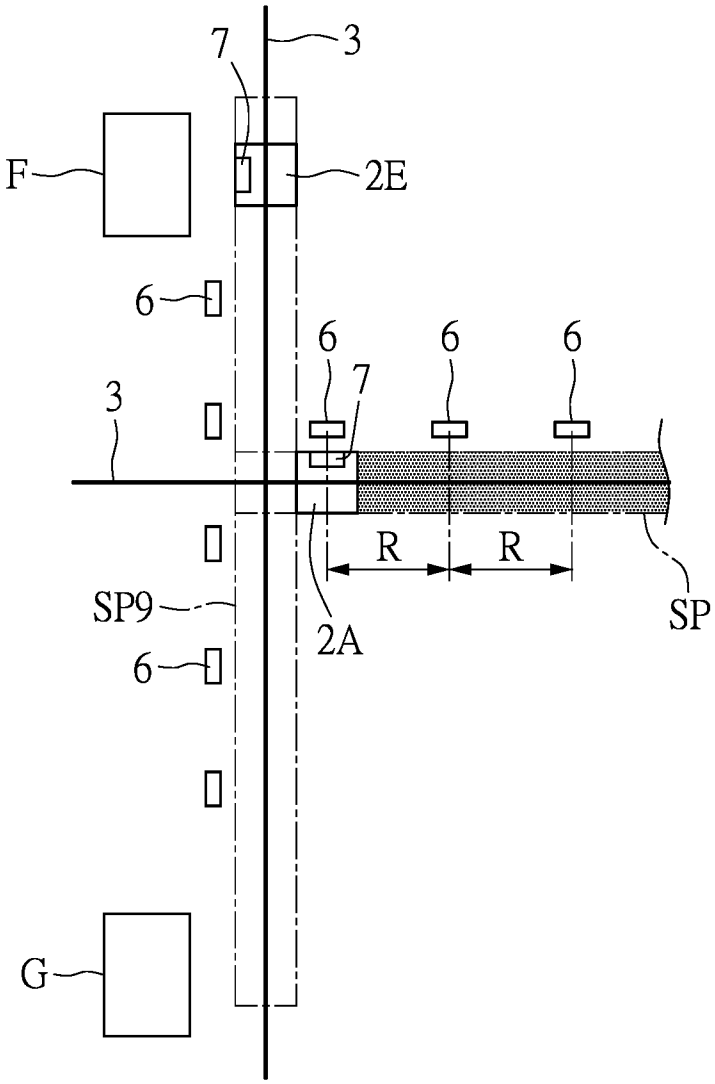
Figure 18:
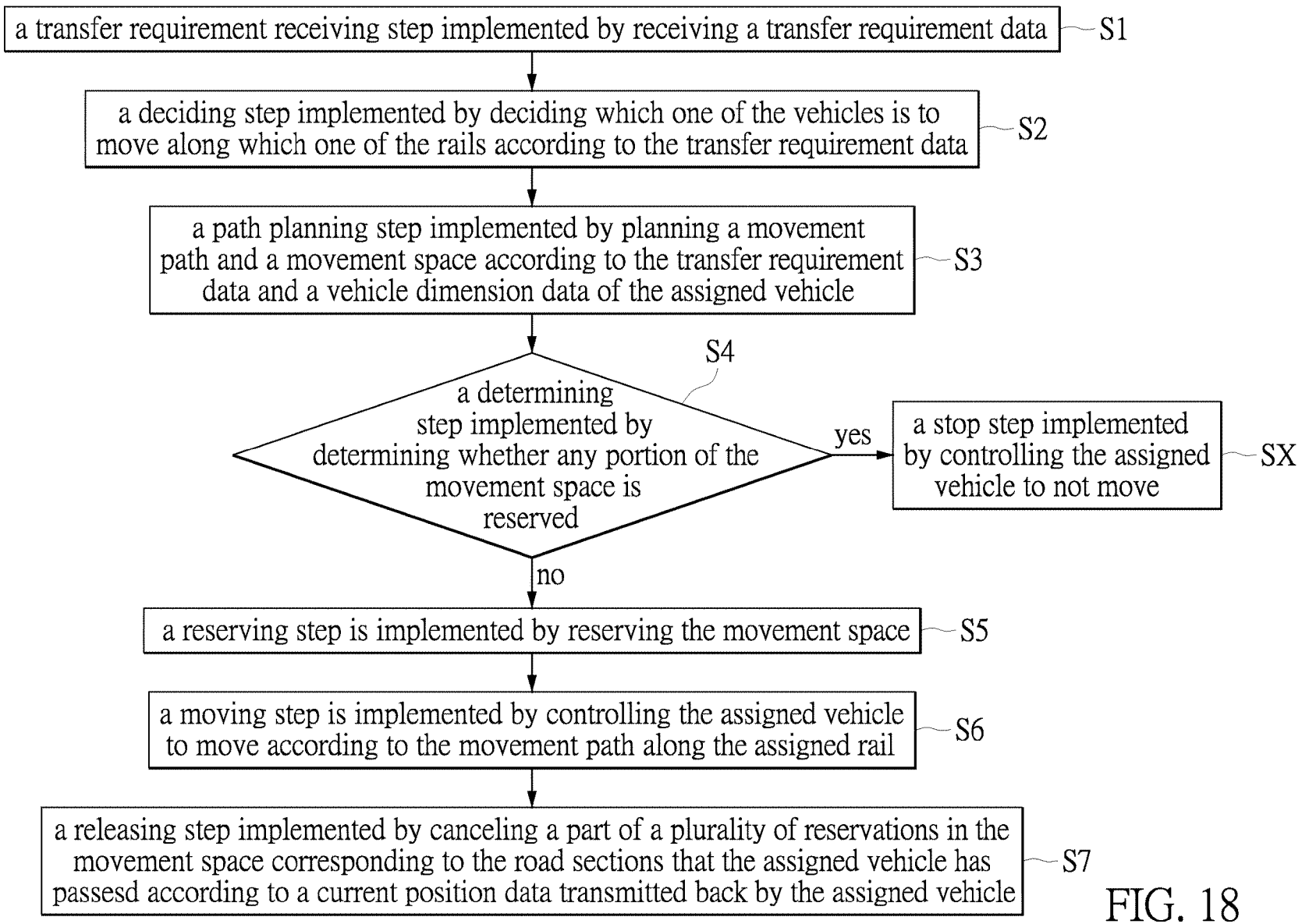
FIG. 18 is a flowchart of the anti-collision control method of another embodiment according to the present disclosure.

Referring to FIG. 1, FIG. 2, FIG. 17, and FIG. 18, FIG. 17 is a top view of the vehicles, the rails, and the movement spaces of an embodiment according to the present disclosure, and FIG. 18 is a flowchart of the anti-collision control method of another embodiment according to the present disclosure. The rail vehicle control system 100 can further include a plurality of rail detecting units 6 and a plurality of vehicle detecting units 7. The rail detecting units 6 are spaced apart from each other and disposed near each of the rails 3, and each of the rails 3 is divided into a plurality of road sections R. Each of the vehicles 2 has at least one of the vehicle detecting units 7 disposed thereon. When the control apparatus 1 implements the moving step S6, and the at least one of the vehicle detecting units 7 detects at least one of the rail detecting units 6, or at least one of the rail detecting units 6 detects the at least one of the vehicle detecting units 7, the control apparatus 1 receives a current position data 8 transmitted by the vehicle 2 or the rail detecting unit 6.

More specifically, each of the rail detecting units 6 can be a one-dimensional barcode, a two-dimensional barcode, or a radio frequency identification (RFID) label, and each of the rail detecting units 7 can correspondingly be a barcode reader or a radio frequency identification reader (RFID reader). When the vehicle 2 moves along the rail 3, the vehicle detecting units 7 read a data (e.g., a data including three-dimensional coordinate positions) stored in the rail detecting units 6, take the data and a related data of the vehicle 2 itself as the current position data 8, and transmit the current position data 8 to the control apparatus 1. Therefore, the control apparatus 1 can know which one of the vehicles 2 has just passed through which one of the rail detecting units 6 according to the current position data 8.

Through the rail detecting units 6 and the vehicle detecting units 7, the control apparatus 1 can further implement a releasing step S7 after implementing the moving step S6. The releasing step S7 is implemented by canceling a part of a plurality of reservations in a movement space corresponding to the road section that the assigned vehicle has passed. In other words, the control apparatus 1 can cancel the reservation of a space corresponding to the road sections R that the assigned vehicle has passed according to the current position data 8 transmitted back by the assigned vehicle, so that the space corresponding to the road sections R that the assigned vehicle has passed can be reserved.

More specifically, as shown in FIG. 17, when the assigned vehicle 2A has passed a rail detecting unit 6A, the control apparatus 1 can know that the assigned vehicle 2A has passed the rail detecting unit 6A through the current position data 8 transmitted by the assigned vehicle 2A. The control apparatus 1 accordingly cancels a reservation in a space around the rail detecting unit 6A, and the control apparatus 1 can reserve a movement space SP9 occupied by another vehicle 2E moving from a position near a working station F to a position near a working station G according to another transfer requirement data.

Figure 19:
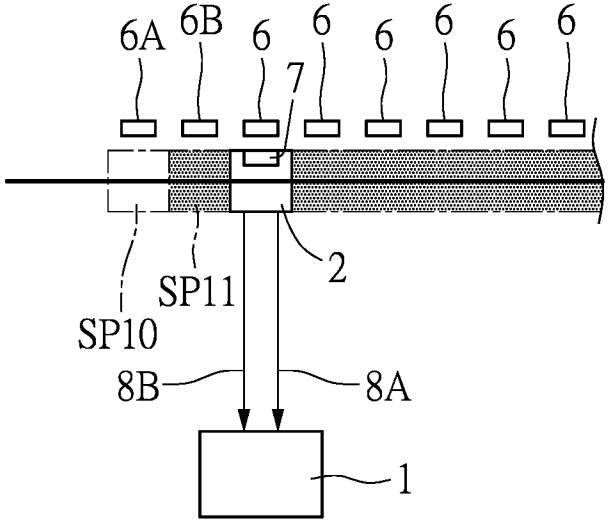
FIG. 19 is a top view of the vehicle, the rail, and the movement space of an embodiment according to the present disclosure.

In other embodiments, after the assigned vehicle 2A passes a predetermined quantity of rail detecting units 6, the control apparatus 1 can release at least one space corresponding to the rail detecting units 6. For example, referring to FIG. 19, FIG. 19 is a top view of the vehicle, the rail, and the movement space of an embodiment according to the present disclosure. After the assigned vehicle 2A sequentially passes the rail detecting unit 6A and the rail detecting unit 6B, and the control apparatus 1 receives a current position data 8A and a current position data 8B sequentially transmitted by the assigned vehicle 2A, the control apparatus 1 can only release a space SP10 corresponding to the penultimate rail detecting unit 6A that the assigned vehicle 2A has passed, and a space SP11 corresponding to the rail detecting unit 6B that the assigned vehicle 2A has just passed can be temporarily not released by the control apparatus 1, so as to better prevent the assigned vehicle 2A from colliding with other vehicles.

In an embodiment of the present disclosure, the control apparatus 1 includes the display device, and the display device can show the rails in the factory building, the position of each of the vehicles, and a range of the movement spaces that are currently reserved. A technical personnel can know the current position of each of the vehicles, the movement path of each of the vehicles, and the corresponding movement spaces by observing the display device.

In a practical application, a simultaneous localization and mapping (SLAM) technique or a magnetic stripe guiding technique can be utilized between the vehicles 2 and the control apparatus 1 in cooperation with a communications protocol such as TCP, UDP, or message queue, and through communication by various types of wireless communication techniques (e.g., 5G or WI-FI®), so that the control apparatus 1 can immediately know the current position of each of the vehicles 2.

BENEFICIAL EFFECTS OF THE EMBODIMENTS

In conclusion, by virtue of the anti-collision control method and the rail vehicle control system of the present disclosure, a probability of the vehicles moving on the rails colliding with each other can be effectively decreased.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An anti-collision control method applicable in a rail vehicle control system, wherein the rail vehicle control system includes a control apparatus, a plurality of vehicles, and a plurality of rails, and the control apparatus is configured to control each of the plurality of vehicles to move along one of the plurality of rails and to implement the anti-collision control method to prevent the plurality of vehicles moving on the plurality of rails from colliding with each other, the anti-collision control method comprising:

a transfer requirement receiving step implemented by receiving a transfer requirement data;

a deciding step implemented by deciding which one of the plurality of vehicles is to move along which one of the plurality of rails according to the transfer requirement data, wherein one of the plurality of vehicles assigned to move along one of the plurality of rails is defined as an assigned vehicle, and at least one of the plurality of rails that the assigned vehicle is assigned to move on is defined as an assigned rail;

a path planning step implemented by planning a movement path and a movement space according to the transfer requirement data and a vehicle dimension data of the assigned vehicle, wherein the movement space is a sum of a plurality of spaces occupied by the assigned vehicle when the assigned vehicle moves according to the movement path on the assigned rail; and a determining step implemented by determining whether any portion of the movement space is reserved;

in response to any portion of the movement space being reserved, a stop step is implemented, and the stop step is implemented by controlling the assigned vehicle to not move; and in response to any portion of the movement space being not reserved, a reserving step and a moving step are implemented;

the reserving step is implemented by reserving the movement space; and the moving step is implemented by controlling the assigned vehicle to move according to the movement path along the at least one assigned rail, wherein, when the assigned vehicle moves to an assigned position according to the movement path, the control apparatus releases the movement space, so as to enable the movement space to be reserved.

2. The anti-collision control method according to claim 1, wherein the movement path includes a plurality of road sections, the anti-collision control method further includes a releasing step after the moving step, and the releasing step is implemented by canceling a part of a plurality of reservations in the movement space corresponding to the plurality of road sections that the assigned vehicle has passed according to a current position data transmitted back by the assigned vehicle.

3. The anti-collision control method according to claim 2, wherein the rail vehicle control system further includes a plurality of rail detecting units and a plurality of vehicle detecting units, the plurality of rail detecting units are spaced apart from each other and disposed near each of the plurality of rails, such that no other assistance is needed to detect parameters from the plurality of rails, each of the rails is divided into the plurality of road sections by the plurality of rail detecting units, and each of the plurality of vehicles has at least one of the vehicle detecting units disposed thereon, and wherein, in the moving step, when the at least one of the vehicle detecting units detects one of the plurality of rail detecting units, or when one of the plurality of rail detecting units detects the at least one of the vehicle detecting units, the control apparatus receives the current position data transmitted by the vehicle or the rail detecting unit.

4. The anti-collision control method according to claim 1, wherein, in the path planning step, the control apparatus records a plurality of endpoint coordinates of the movement space, in the reserving step, the control apparatus records the plurality of endpoint coordinates corresponding to the movement space as a plurality of reserved coordinates, and in the determining step, the control apparatus determines whether any portion of the movement space overlaps with a reserved space according to the plurality of endpoint coordinates and the reserved coordinates.

5. The anti-collision control method according to claim 1, wherein the transfer requirement data includes the vehicle dimension data, and wherein, in the path planning step, the control apparatus plans the movement space according to the movement path and the vehicle dimension data.

6. The anti-collision control method according to claim 1, wherein, in the path planning step, the control apparatus plans the movement space according to the movement path and a vehicle posture data.

7. The anti-collision control method according to claim 1, wherein, in the path planning step, the control apparatus plans the movement path and the movement space according the vehicle dimension data of the assigned vehicle and an auxiliary device data, and wherein the movement space is a sum of a plurality of spaces occupied by the assigned vehicle and an auxiliary device disposed on the assigned vehicle when the assigned vehicle moves according to the movement path on the assigned rail.

8. The anti-collision control method according to claim 7, wherein the auxiliary device includes at least one of a detector and a holding structure, the detector is configured to detect a surrounding environment of the vehicle, and the holding structure is configured to hold and transfer an object to be transferred.

9. The anti-collision control method according to claim 7, wherein the auxiliary device data includes an emergency braking distance data, and in the path planning step, the control apparatus plans the movement space according to the movement path, the vehicle dimension data, and the emergency braking distance data.

10. The anti-collision control method according to claim 1, wherein the transfer requirement data includes an object to be transferred data, and the movement space is a sum of a plurality of spaces occupied by the assigned vehicle and an object to be transferred disposed on the assigned vehicle when the assigned vehicle moves according to the movement path on the assigned rail.

11. A rail vehicle control system comprising a control apparatus, a plurality of vehicles, and a plurality of rails, wherein the control apparatus is configured to control each of the plurality of vehicles to move along one of the plurality of rails, the control apparatus is configured to implement an anti-collision control method to prevent the plurality of vehicles moving on the plurality of rails from colliding with each other, and the anti-collision control method includes:

a transfer requirement receiving step implemented by receiving a transfer requirement data;

a deciding step implemented by deciding which one of the plurality of vehicles to move along which one of the plurality of rails according to the transfer requirement data, wherein one of the plurality of vehicles assigned to move along one of the plurality of rails is defined as an assigned vehicle, and at least one of the plurality of rails that the assigned vehicle is assigned to move on is defined as an assigned rail;

a path planning step implemented by planning a movement path and a movement space according to at least a vehicle dimension data of the assigned vehicle, wherein the movement space is a sum of a plurality of spaces occupied by the assigned vehicle when the assigned vehicle moves according to the movement path on the at least one assigned rail; and a determining step implemented by determining whether any portion of the movement space is reserved;

in response to any portion of the movement space being reserved, a stop step is implemented, and the stop step is implemented by controlling the assigned vehicle to not move along the movement path; and in response to any portion of the movement space being not reserved, a reserving step and a moving step are implemented;

the reserving step is implemented by reserving the movement space; and the moving step is implemented by controlling the assigned vehicle to move according to the movement path along the at least one assigned rail, wherein, when the assigned vehicle moves to an assigned position according to the movement path, the control apparatus releases the movement space, so as to enable the movement space to be reserved.

* * * * *